US011174078B2

(12) United States Patent
Krautkrämer

(10) Patent No.: US 11,174,078 B2
(45) Date of Patent: Nov. 16, 2021

(54) POURING CLOSURE

(71) Applicant: BERICAP Holding GmbH, Budenheim (DE)

(72) Inventor: Günter Krautkrämer, Budenheim (DE)

(73) Assignee: BERICAP Holding GmbH, Budenheim (DE)

( * ) Notice: Subject to any disclaimer, the term of this patent is extended or adjusted under 35 U.S.C. 154(b) by 211 days.

(21) Appl. No.: 16/472,004

(22) PCT Filed: Dec. 13, 2017

(86) PCT No.: PCT/EP2017/082567
§ 371 (c)(1),
(2) Date: Jun. 20, 2019

(87) PCT Pub. No.: WO2018/114513
PCT Pub. Date: Jun. 28, 2018

(65) Prior Publication Data

US 2019/0329938 A1 Oct. 31, 2019

(30) Foreign Application Priority Data

Dec. 20, 2016 (DE) ..... 10 2016 124 947.5

(51) Int. Cl.

| | |
|---|---|
| ***B65D 39/00*** | (2006.01) |
| ***B65D 47/36*** | (2006.01) |
| *B65D 5/74* | (2006.01) |
| *B65D 47/10* | (2006.01) |

(52) U.S. Cl.
CPC ..... *B65D 39/0005* (2013.01); *B65D 47/36* (2013.01); *B65D 5/746* (2013.01);
(Continued)

(58) Field of Classification Search
CPC ..... B65D 2205/00; B65D 2251/0093; B65D 39/0005; B65D 47/103; B65D 47/36; B65D 5/746
(Continued)

(56) References Cited

U.S. PATENT DOCUMENTS 5,810,184 A 9/1998 Adams et al.
6,247,605 B1 * 6/2001 Fujie ..... B65D 47/123 215/256
(Continued)

FOREIGN PATENT DOCUMENTS

CN 1169702 A 1/1998
CN 1538923 A 10/2004
(Continued)

OTHER PUBLICATIONS

International Preliminary Report On Patentability for International Application No. PCT/EP2017/082567, dated Jun. 25, 2019.
(Continued)

*Primary Examiner* — Don M Anderson
*Assistant Examiner* — Madison L Poos
(74) *Attorney, Agent, or Firm* — Morgan, Lewis & Bockius LLP

(57) ABSTRACT

Pouring closure for liquid containers with pour spout sealingly fixed to a container neck, the cross section of which is closed by a membrane before use. A portion of the membrane extends transversely, approximately pear-shaped, and connected to the remaining portion via an easily tearable line of weakness and can be detached from the membrane. After detachment, an opening in the membrane is released that is correspondingly pear-shape, and liquid poured selectively out of a relatively narrower section or wider section. The pouring closure is produced by tearing out a membrane section and facilitates dosed pouring. Webs on the inner
(Continued)

Figure 1:
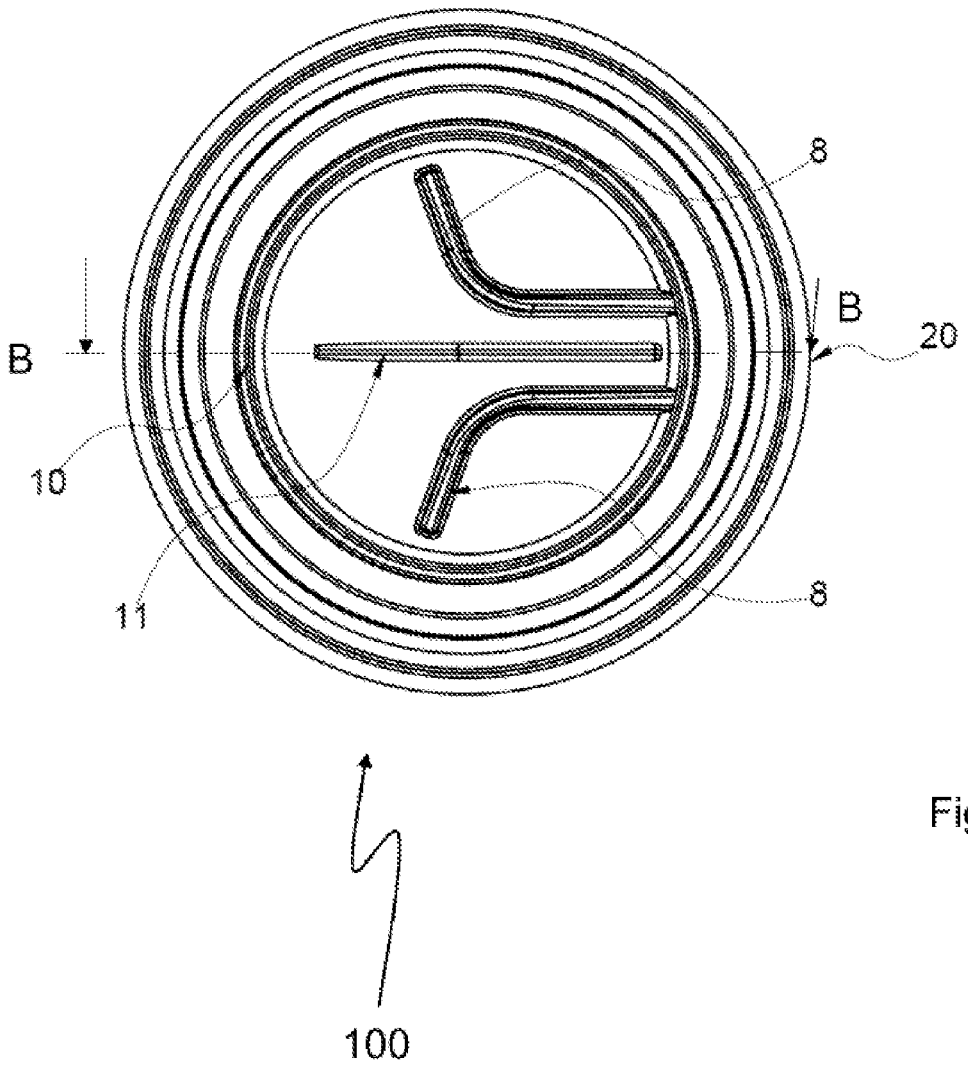

surface at a close distance parallel to the line of weakness and outside the tear-out section run on both sides of the narrow section of the tear-out portion or of the opening and along at least a portion of a transition region between the narrower and the wider sections.

19 Claims, 7 Drawing Sheets

(52) U.S. Cl.
CPC ..... *B65D 47/103* (2013.01); *B65D 2205/00* (2013.01); *B65D 2251/0093* (2013.01)

(58) Field of Classification Search
USPC ..... 215/355, 45; 220/258.2, 269; 222/153.07
See application file for complete search history.

(56) References Cited

U.S. PATENT DOCUMENTS

| | | | |
|---|---|---|---|
| 10,081,463 | B2 | 9/2018 | Taggart et al. |
| 2004/0245290 | A1 | 12/2004 | Hagihara |

FOREIGN PATENT DOCUMENTS

| | | | | |
|---|---|---|---|---|
| CN | 2695377 | Y | | 4/2005 |
| CN | 202208436 | U | | 5/2012 |
| CN | 105083674 | A | | 11/2015 |
| EP | 1026100 | A1 | | 8/2000 |
| EP | 2495185 | A1 | | 9/2012 |
| FR | 2900909 | A1 | | 11/2007 |
| FR | 2963779 | A1 | * | 2/2012 |
| JP | S59-33109 | A | | 2/1984 |
| JP | 2006-264739 | A | | 10/2006 |
| WO | 2008/080053 | A1 | | 7/2008 |

OTHER PUBLICATIONS

International Search Report dated Feb. 27, 2018, issued in corresponding International Patent Application No. PCT/EP2017/082567.

Search Report dated Jun. 2, 2017, issued in corresponding German Patent Application No. 10 2016 124 947.5.

First Office Action dated Mar. 30, 2020 in Chinese Application No. 201780078961.6.

* cited by examiner

POURING CLOSURE

The present invention relates to a pouring closure for liquid containers with a pour spout which can be sealingly fixed to a container neck and the cross section of which is closed by a membrane before use, wherein a portion of the membrane extending transversely over the membrane and approximately pear-shaped in plan view, which is connected to the remaining portion via an easily tearable line of weakness, can be detached from the membrane and releases a membrane opening, which is correspondingly pear-shaped in plan view, with the result that liquid can be poured selectively out of a relatively narrower section of the pear-shaped opening or out of a relatively wider section of the pear-shaped opening when the container is tilted, depending on the orientation thereof.

The term "pear-shaped" here defines coherent sections of a surface, wherein the sections are connected to each other and wherein the smaller section tends to have a narrow, elongated shape and the wide section tends to have a round shape which is more closely approximated to a circular shape.

This definition applies, for example, to the silhouette of a pear, which consists of a relatively narrow, more or less conical or slightly bell-shaped section which turns into a more spherical end via a concave curvature. The actual shape, in particular the width and shape of the narrow section in relation to the wider section, can however also differ to a greater extent from the contour of a real pear and adopt e.g. the silhouette of a mushroom or a water tower (see embodiment example). The narrow section can in particular also be delimited by two parallel sides and can be 5 to 20 times narrower than the maximum width of the wide section over most of its length. All of these shapes are combined under the term "pear shape", even if a real pear would not achieve such contours.

Ultimately, in the case of this specific shape of the opening, which is incidentally already known from the state of the art, the point is that the flow rate is substantially more restricted when liquid is poured out only through the narrow section and the quantity of liquid can thus be dosed more easily than when pouring out through the wider section. In order to dose a quantity of liquid more precisely, the user rotates the container such that when the container with the pour spout fitted is tilted the narrow section of the opening in the membrane lies at the bottom, with the result that the liquid only comes out through this narrow section so long as the container is not tilted excessively, with the result that the liquid level would then also reach into the region of the wide opening. The tilting position with the narrow section of the opening rotated downwards is called the "dosing position" here.

If on the other hand a large quantity of the liquid is to be poured out or the container is to be completely emptied, the container can be rotated such that when it is tilted the wide opening lies at the bottom, with the result that the liquid largely flows out through the cross section thereof, which is substantially larger than the cross section of the narrow opening and which moreover is approximately circular, which with the same cross section would also reduce the flow resistance compared with long, narrow cross-sectional shapes.

Before use, however, this pear-shaped opening is closed by the membrane and the exact shape of the opening is defined here by the course of a line of weakness on the otherwise circular disc-shaped membrane, which completely closes the generally cylindrical cross section of the pour spout before use.

Of course the pour spout could also have a cross-sectional shape other than circular, with the result that the membrane shape would also need to be adapted correspondingly. For the present invention, ultimately the only thing that matters is that, after a portion of the membrane has been torn out, the mentioned "pear shape" of the pouring opening which makes the desired pouring behaviour described above possible is obtained, wherein, at least outside the narrow section of the opening being formed, a portion of the original membrane still restricts the free cross section of the pour spout.

A corresponding closure is known from FR 2 963 779, in which a membrane extending transversely over the pouring cross section has a large opening and a small opening, which are connected to each other via a narrow point, and which are released by tearing out a detachable portion of the membrane along a line of weakness. Here a web is also provided on the inner surface of the membrane at a close distance beside the line of weakness, which extends inwards away from the membrane surface and around the small opening and from there runs along the narrow point between the smaller and larger openings up to both sides of the large opening. This web has its greatest height in the region of the small opening and is to ensure the inflow of air and to prevent liquid from flowing out through the small opening, in order to prevent glugging or liquid coming out of the closure opening intermittently when a liquid is poured out. A precise dosing of the liquid by pouring out only through the small opening is scarcely possible in this embodiment.

Pouring closures of the above-named type (and thus also the pouring closures according to the invention) are often used in containers for edible oil, which sometimes has to be dosed more precisely depending on the application.

In the case of pouring closures of this type, insofar as they are already known per se, it has however proved to be problematic to design the narrow section and the wider section of the pouring opening such that when the container is tilted the liquid actually always comes out only through the desired narrower or wider region and in the process also forms a jet of liquid which is easy to handle and comes out evenly.

A further problem with this form of pouring openings which are produced by detaching a portion of a membrane lies in the stability of the line of weakness and of the regions adjoining the line of weakness. In principle the membrane is a one-piece disc, the outer contour of which is usually cylindrical and is in any case matched to the inner contour of the pour spout. The line of weakness is introduced either during the injection moulding or alternatively by carving or impressing a corresponding contour into the surface of the disc on one side, for example on its outer surface. Typically a pull-out aid, in particular a pull-out ring, is attached to the free end of the wider section of the membrane portion to be detached, with the result that for use of the closure by the user first the wider section is pulled out of the plane of the membrane with the aid of the pull-ring, while the membrane tears along the line of weakness.

Here, the ends of the narrow and of the wide sections facing away from each other (both for the detachable portion of the membrane and for the opening being formed) are referred to as "free ends" of the narrower and of the wider section respectively. The terms "narrow" and "wide" are not absolute, but are to be understood in relation to each other.

In particular in the case of changes to the course of the line of weakness or in the region of the narrow section, however, it may occur that the membrane does not tear precisely along the line of weakness, but that instead the membrane material next to the line of weakness begins tearing, wherein this tear, once introduced into the membrane material, continues in a fully uncontrolled manner upon further pulling on the pull-ring with the result that a more or less undefined opening is formed or additional portions of the membrane also tear off and partially also protrude into the produced opening with the result that the latter is again partially obstructed. This leads to an uncontrolled pouring behaviour of the liquid when the container is tilted, even if the user attempts to orient the opening now produced, but shaped irregularly and other than as intended, in such a way that the quantity of liquid coming out can be controlled and dosed as precisely as possible.

It has furthermore transpired that the dosing of the liquid is still difficult in the case of relatively full containers, as the liquid level very quickly reaches the transition to the wide region, often when the container is tilted only slightly with the narrow opening rotated downwards or in the tilting direction, and a significantly larger quantity of liquid then flows out through the suddenly widening opening when the upper end of the narrow section is exceeded only marginally. This applies in particular to higher-viscosity liquids such as e.g. edible oil, which tend towards an uncontrolled venting behaviour (glugging or liquid coming out intermittently).

For this purpose, corresponding so-called venting closures have also been developed in the state of the art, which reduce the outlet cross section and have a series of smaller slits adjoining a central pouring cross section through which air can better flow into the container.

Since this type of venting slit or opening with star-shaped extensions typically lies underneath the region which is closed by a membrane in the pour spout, it would also additionally be possible to combine such venting elements with the subject-matter of the present invention.

Finally it has been shown in the case of conventional closures of this type that, even if the container is tilted just far enough that liquid comes out only through the narrow section, the jet of liquid coming out is not even and smooth, but partially splits, has a varying cross section and/or fluctuates.

As opposed to the state of the art discussed above, the object of the present invention is therefore to provide a pouring closure for liquid containers of the type named at the beginning, in which on the one hand the pouring opening can be produced in a very controlled and well-defined manner by tearing out a membrane section and which on the other hand further facilitates the dosed pouring out of liquid.

This object is achieved in that the membrane has webs on its inner surface, at a close distance beside the line of weakness outside the tear-out section of the membrane, which extend inwards away from the membrane surface, i.e. in the direction of the container interior, and which run on both sides of the narrow section of the tear-out portion of the membrane or of the corresponding opening and along at least a portion of the transition region between the narrower and the wider sections, wherein the web height increases from the beginning of the webs (8) close to their first end of the narrow section (6) remote from the wide section (7) as it approaches the transition region (9).

Due to their shape and arrangement, the webs make it possible for the liquid to come out through the narrow region when pouring out with the narrow region rotated downwards, as the webs get higher towards the transition region and make it possible for the liquid to come out through the narrow region in the case of a tilt angle at which the wide region is still screened from the liquid coming out by the webs.

The webs do not already have their maximum height in proximity to the lower end of the narrow opening, as the web height increases from the beginning of the web close to the first end of the narrow section (which is located away from the wide section) as it approaches the transition region and preferably at least doubles up to a maximum web height.

The web height could thus be e.g. 2 mm in proximity to the lower end of the narrow opening and e.g. 5 mm in proximity to the transition region, wherein it can then decrease again in its further course, if the web also extends further as far as clearly into the region of the wider section. The webs preferably end alongside the wide region, but at a distance before the outer edge of the membrane, whereas the wider opening clearly approaches the outer edge of the membrane or the inner wall of the pour spout and is less than 2 mm, preferably less than 1 mm, for example at the end of the wide opening opposite the narrow section. In this region only residues of the membrane remain, which are caused by the fact that the line of weakness in this region cannot terminate flush with the membrane If when the container is tilted the narrow opening is then directed downwards, wherein the liquid level gradually rises from the lower edge of the narrow opening to the upper edge as the tilt angle increases, the liquid will initially flow out exclusively through the narrow section of the opening and, in the case of greater tilting, when the liquid level reaches the end of the narrow section, the liquid is prevented by the webs, outside the narrow opening, from flowing past and directly into the adjoining region of the wider opening and thus suddenly coming out of the pour spout in a larger quantity.

The webs, which extend along the transition region and as far as or into the wider region, instead deflect the liquid outwards or hold it back and would only allow liquid to flow out over their upper edge and then over the wider section in the case of an even greater tilt angle.

These webs are also referred to as "deflectors" due to this flow deflection and blocking.

The webs have, for example, the shape of strips with an approximately rectangular cross section which can vary along their extent along the line of weakness, primarily in a direction perpendicular to the membrane surface. In particular, the larger cross-sectional dimension of the webs runs approximately perpendicular to the inner surface of the membrane.

The webs which run parallel to the transition region and the adjoining portion of the narrow section firstly form a kind of edge reinforcement of the line of weakness or of the opening being formed precisely where, in the case of conventional closures of this type, the membrane typically begins tearing in an uncontrolled manner outside the region provided for the opening. The webs prevent the membrane from beginning tearing along the line of weakness in the direction of the portion lying outside the opening.

In addition, in an embodiment the narrow tear-out portion of the membrane can also be reinforced by a further web which extends along the narrow section and approximately in the centre thereof and which is referred to below as "rib" for easier distinction. This rib is also at a small distance from the line of weakness since the line of weakness has to run on both sides of the rib at a close distance therefrom in the narrow section, because the line of weakness here delimits only a correspondingly narrow section of the opening or of the tear-out portion of the membrane.

This central rib reinforces the material of the tear-out section next to the line of weakness and reinforces the narrow tear-out section as a whole and in this way prevents the membrane material on the side of the narrow section from beginning tearing when the tear-out portion is torn out. In the process the narrow section could tear off before the line of weakness is separated up to the free end of the narrow section.

As a result the webs and the central rib ensure that the membrane begins tearing and the tear-out membrane portion tears off along the whole circumference of the opening and in particular in the narrow part of the opening precisely along the predefined line of weakness. The narrow opening thereby produced is thus reliably and precisely defined, wherein this is incidentally also true of the wide part of the opening in which, however, small deviations from the precise contour of the line of weakness are less critical as the wide opening need not enable precise dosing.

With regard to the distances from the line of weakness, substantially the same applies to the reinforcing rib as to the webs, wherein this distance is ultimately also determined by the width of the detachable portion and the width of the rib and wherein, in the case where the narrow section is deliberately to have a greater width of e.g. 10 mm or more, the reinforcing rib could also be arranged in the form of two parallel ribs along the lines of weakness on the detachable portion.

One difference between the reinforcing ribs which reinforce the detachable narrow portion of the membrane and the webs outside the narrow section consists, however, above all in the height of the webs or reinforcing ribs. While for example a doubling or at most tripling of the wall thickness of the membrane is sufficient for the purely reinforcing function, the webs on the inner surface of the membrane, which extend along the narrow section of the detachable portion and in the transition region or along the opening being formed, have a further function in that they influence the pouring behaviour of the liquid. For this reason the maximum height of the webs, measured perpendicular to the membrane surface, is between 2 and 10 mm or in more general terms more than 10% and up to 50% of the internal diameter of the pour spout for pouring closures with different dimensions, wherein in the case of non-cylindrical pour spouts it would be possible to use the average of the internal diameter as benchmark here. The minimum height of the webs at their outer ends can have the value zero, wherein it is preferred however for the webs to begin close to the free end of the narrow section already at the wall or in direct proximity (e.g. at a distance of at most 2 mm, preferably at most 1 mm) to the wall of the pour spout and to have an initial height of at least 1 mm, preferably 2 mm.

The maximum height of the web is preferably located in proximity to the transition region from the narrow to the wider section of the opening or of the detachable portion of the membrane. The transition region of the pear shape here is, for example, defined by a concave section of the outer contour. While the narrow section is substantially convexly curved at its end and is otherwise defined, for example, by straight and in particular parallel contour lines, the transition to a wider region must occur at some point which then necessarily has a concave contour.

Insofar as this concave contour is clearly identifiable, the transition region is also defined and determined by this concave section. In the case of opening contours for which such a concave transition region is not clearly identifiable and in particular cannot be narrowed down to a region which makes up less than 20% of the diameter of the pour spout (measured between the free ends of the wide and narrow sections lying opposite each other), the transition region is defined by a region the boundaries of which lie at 45% and 55% of the diameter between the free ends of the narrow and wide sections. In any case the opening widens either in a concave form or in the form of two diverging sides in the region of the transition section and it is precisely in this region that the webs have their maximum height, which can be, for example, 5 mm or 6 mm in the case of a pour spout with a diameter of 20 mm.

As far as the webs along the narrow section are concerned, it would in fact not be absolutely necessary for them already to begin close to the free end of this section and therefore at or close to the edge of the membrane; however it has been shown that the flow behaviour of the liquid (in particular edible oil) in the case of almost all, in particular also in the case of small tilt angles of the container becomes particularly consistent if the webs begin at a distance of less than 3 mm, preferably less than 2 mm, from the outer membrane edge, wherein the free end of the narrow section is also at a distance of at most 1 mm from the edge of the membrane.

The distance of the webs from the line of weakness along the narrow section and preferably also along the transition region is at most 10% of the membrane diameter, in particular at most 3 mm and preferably at most 2 mm.

The pear-shaped opening, i.e. the whole pouring opening consisting of the narrow section and the wide section, extends with its ends facing away from each other approximately over the whole diameter of the membrane and preferably also comprises the geometric centre of the membrane, wherein slight offsets or displacements towards the membrane centre are of no consequence.

The narrow section extends from its first end located close to the wall of the pour spout to the centre of the membrane and preferably slightly beyond it and is preferably defined by two parallel lateral edges which are at a clear distance of from 1 to 3 mm.

The wide opening has a maximum width which in an embodiment is at least one third, preferably more than half of the membrane diameter, wherein the wide opening extends in the radial direction as far as the narrow section over slightly less than half the membrane diameter. In any case, in some embodiments the length and width of the narrow section and the length and width of the wide section are chosen such that the cross section of the narrow section is less than one third of the cross section of the wide section. The cross-sectional area of the wide section is preferably at least one fifth in relation to the whole membrane surface area.

Expediently, one of the two free ends of the detachable portion of the membrane, thus either the free end of the narrow section or the end of the wide section facing away therefrom, is provided with a pull-out aid, which is preferably formed as a pull-out ring.

Figure 2:
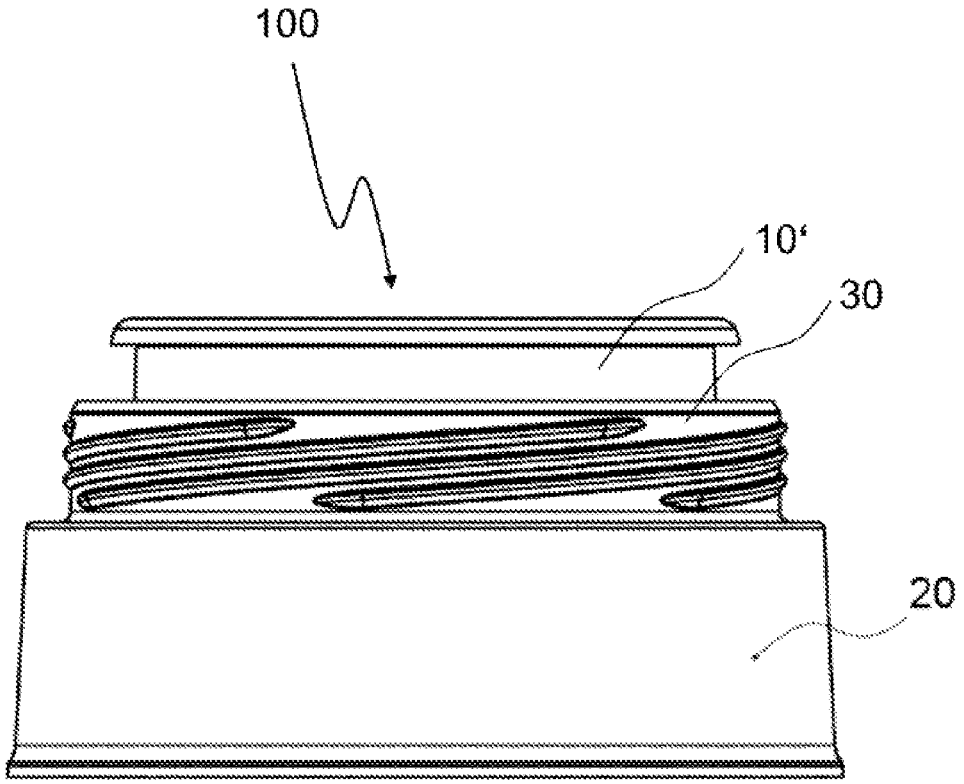
Figure 3:
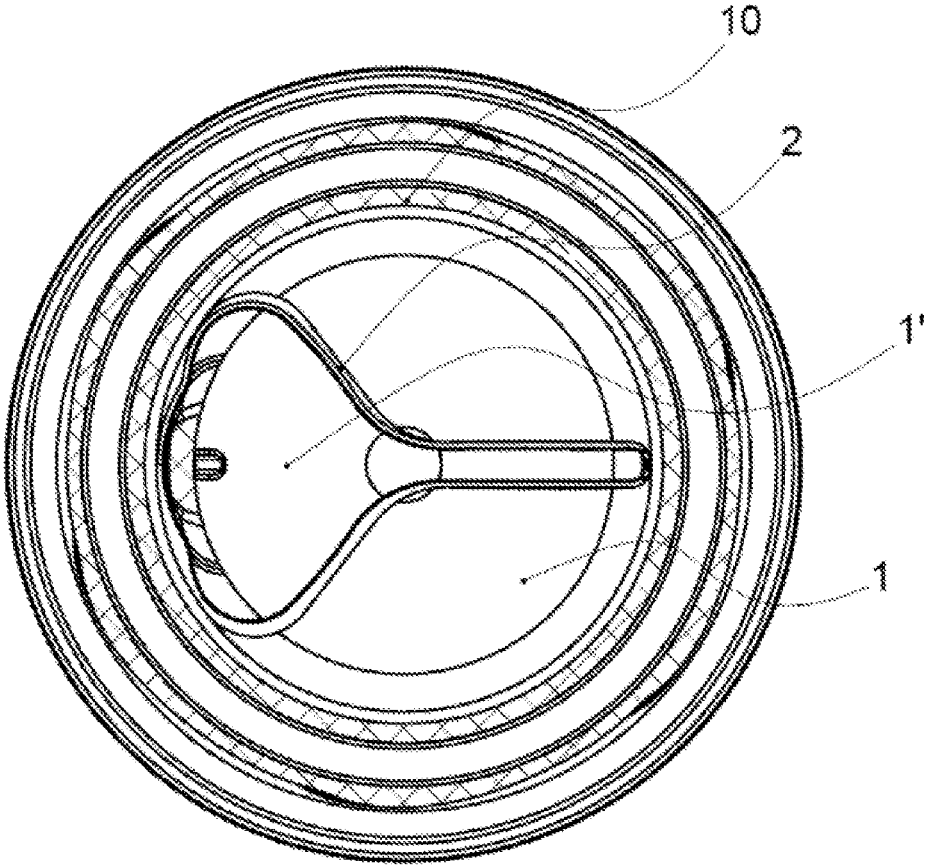

Further advantages, features and possible applications of the present invention become clear with reference to the following description of a preferred embodiment and the associated figures. There are shown in:

FIG. 1 a plan view of a pouring closure from inside and below,

FIG. 2 a side view of the closure,

FIG. 3 a view of the closure according to FIG. 1 from above, wherein the pull-ring has been omitted, FIG. 4 a sectional view along the line BB in FIG. 1, FIG. 5 a perspective view of the pouring closure from below, FIG. 6 a plan view of a closed membrane from below, FIG. 7 a plan view of an opened membrane from below.

A closure 100 can be seen in FIGS. 1 to 5, which can be snapped onto a cylindrical neck of a container and which has an outer closure casing 20 encompassing a container neck from the outside and an inner pour spout 10, the lower section of which tightly engages with the inner surface of a container neck. The transition between the lower and the upper section 10' of the pour spout 10 is closed by a membrane 1 extending over the cross section of the pour spout 10. The closure also has a threaded attachment 30 surrounding the upper section of the pour spout 10, which serves for closing by means of a screw cap (not shown).

In the plan view from above according to FIG. 3, a membrane 1 with an approximately pear-shaped, central and detachable section 1', which is bordered by a line of weakness 2 drawn in in bold, can be seen inside the pour spout 10. The line of weakness 2 is introduced (carved or impressed) into the surface of the membrane 1 from the outside and is therefore not visible in a view from below (FIG. 1).

Figure 5:
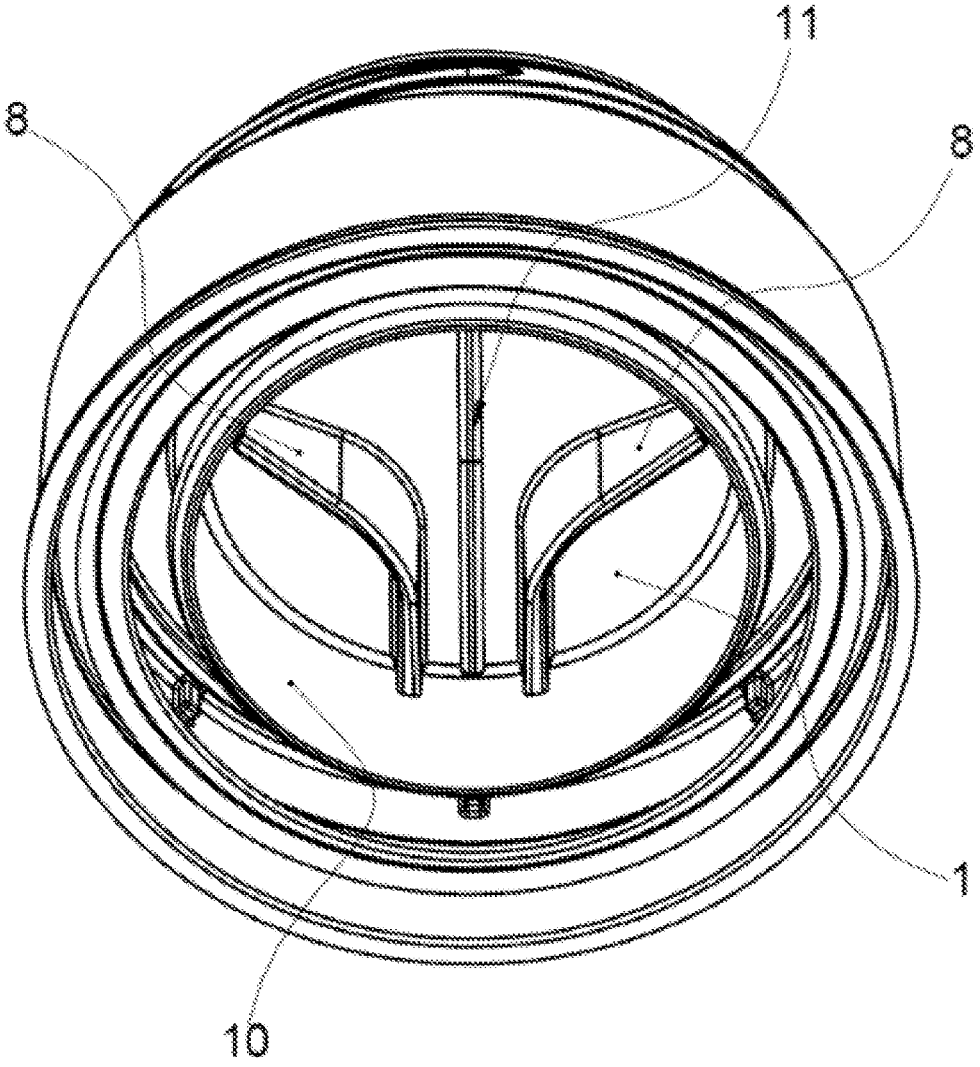
Figure 6:
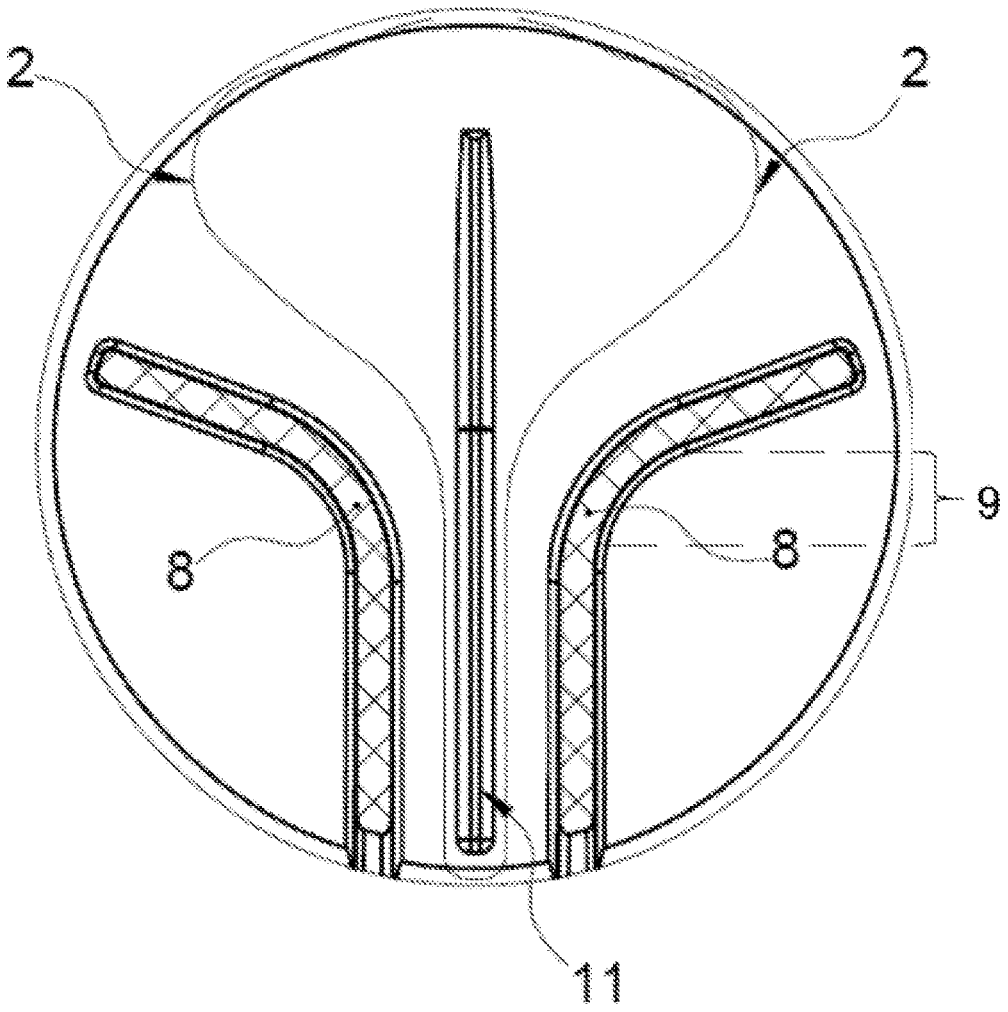
Figure 7:
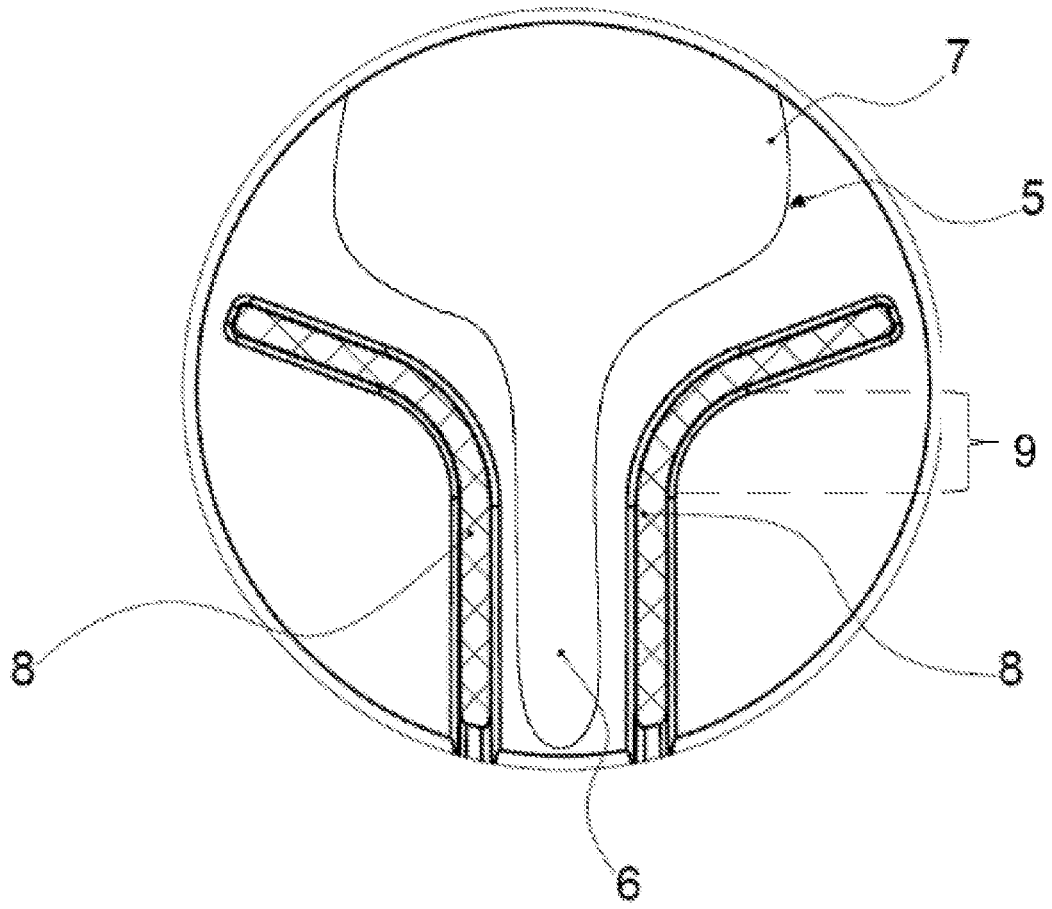

In the perspective view from below according to FIG. 5, it can be seen that two curved webs 8 run on the right and on the left on the inner surface of the membrane, which follow approximately the course of the line of weakness 2, without this being visible in FIG. 5, and in fact, as can be seen in FIGS. 6 and 7, above all along the narrow section of the detachable portion 1', beyond a transition region 9, and which extend into the lower half of the wide section of the tear-out portion 1' of the membrane 1.

The transition region is defined here by that section of the line of weakness between the narrow and the wider section of the detachable portion 1' which is characterized by a concave curvature of the line of weakness 2, which otherwise has a substantially convex course.

Figure 4:
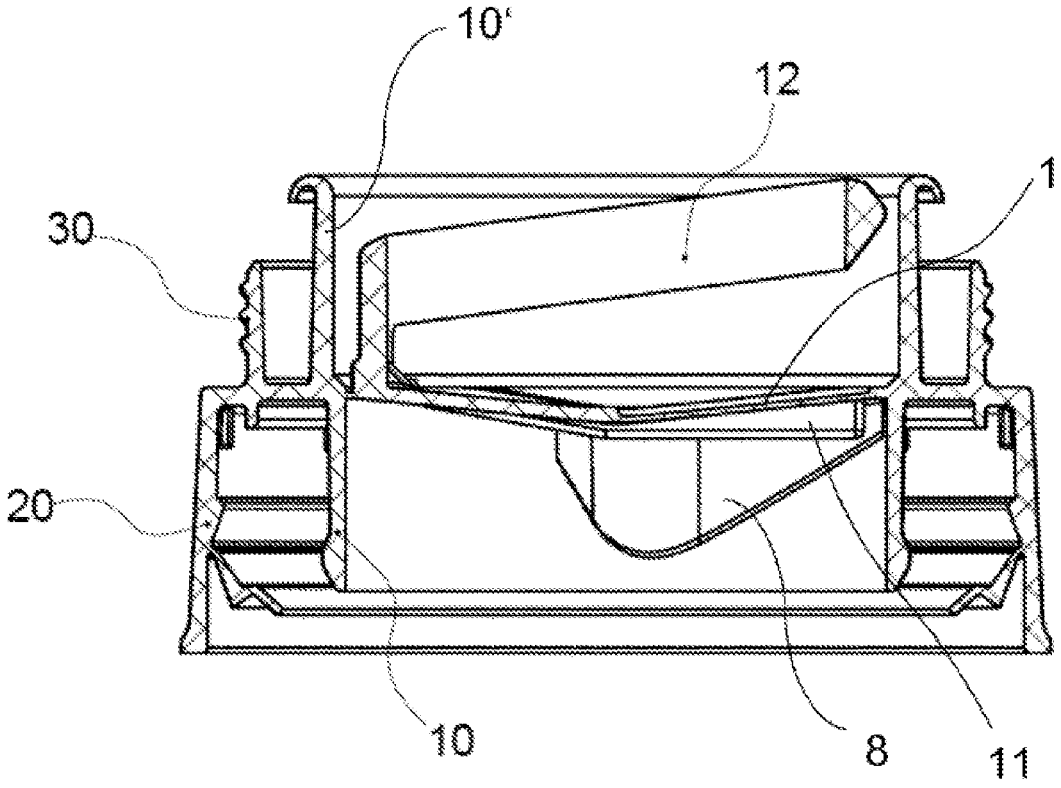

Furthermore, a central rib 11 extending diametrically over the inner surface of the membrane, which serves above all for reinforcing the narrow section of the detachable portion 1', can also be seen in FIG. 5. The height of the rib 11 increases along the narrow section of the portion 1' towards the free end of this narrow section. (FIG. 4)

In the sectional view according to FIG. 4, it can furthermore be seen that, in the side view, the webs 8 have a relatively low web height from a point close to the free end of the narrow section of the detachable portion 1' of the membrane 1, which then rises approximately linearly up to a maximum value and decreases again towards the other end which is curved away from the plane of FIG. 4. The maximum height of the webs 8 is located in that region which lies closest to the transition region 9 of the line of weakness. The perspective representation in FIG. 5 shows the shape and the course of the webs 8 relatively well. In this region, the webs in plan view likewise have a concave curvature similar to the line of weakness 2.

The free end of the wide section of the detachable portion 1' of the membrane is connected to a pull-ring 12, with the result that when the pull-ring 12 is pulled, initially the free end of the wide section of the detachable portion 1' is detached and torn away from the membrane 1 along the line of weakness 2, whereupon when the pull-ring 12 is pulled further, the connection between the detachable portion 1' and the remaining portion of the membrane 1 is severed along the line of weakness 2. Finally, beyond the transition region 9 the narrow section of the detachable portion 1' is also seized by the tensile force applied to the pull-ring, with the result that the whole detachable portion 1' of the membrane can then be separated off along the line of weakness (see FIG. 6) and removed.

In the transition region 9 and along the narrow section the webs 8 and the central rib 11, which form a reinforcement of the membrane material on both sides of the line of weakness 2, ensure that the membrane does not begin tearing on either side of the line of weakness 2 causing the edge of the opening being formed to then run in an uncontrolled manner. The reinforcements through the webs 8 and the rib 11 therefore ensure that the detachable portion 1' of the membrane 1 also tears off in the transition region 9 and in the narrow region precisely along the predefined line of weakness 2 and then leaves an opening 5 which corresponds exactly to the shape of the detachable portion 1' which is predefined by the line of weakness.

The opening formed in this way is as a whole denoted by 5, the narrow part of the opening 5 by 6 and the wide part of the opening 5 by 7 (see FIG. 7).

The reinforcing rib 11 is removed together with the detachable portion 1' of the membrane, with the result that ultimately a membrane 1 remains with the mentioned opening 5 and the webs 8, which extend above all along the narrow section 6 of the opening along the transition region 9 and along the edge of the wide opening in a section adjoining the transition region up to a certain distance before the circumference of the membrane.

With reference to FIG. 7 it can also be seen that in the region of the narrow opening 6 and also in the transition region 9 the webs 8 follow the edge of the narrow opening 6 or the line of weakness 2 at a relatively close distance parallel thereto. The ends of the webs 8 which run further away from each other beyond the transition region can then be at an increasingly greater distance from the edge of the wide section 7 of the opening 5.

With reference to the perspective representation of the webs 8 in FIG. 5 and also in view of the contour of the webs according to the representation in FIG. 4, it can be seen that after a container is tilted with the pouring closure in the dosing position the liquid, when it flows against the inner surface of the membrane with the opening 5 produced in the meantime, can initially only flow through between the sides of the webs 8 running parallel, to the corresponding narrow opening 6 and through the latter.

When the liquid level rises due to an increase in the tilt angle, the webs getting increasingly higher towards the transition region prevent the liquid from also flowing laterally in the direction of the wider opening 7 and through the latter. Thus it is achieved that the tilt angle of the container can vary in a relatively large range without the liquid overcoming the obstacle of the webs 8. The liquid is deflected outwards by the webs 8 into a region which only comes to be located below the liquid level in the case of a relatively large tilt angle. The webs are for this reason also referred to as "deflectors" here. The liquid can then still come out through the full cross section of the narrow region, however without appreciable additional quantities of the liquid also being able to flow out through the wider section 7 of the opening 5. In this way it is ensured that the dosing position allows a much larger tilt angle range as opposed to closures which have no such webs at all and thus significantly facilitates the dosing of liquid.

If the closure or the container is rotated such that when the container is tilted the wide opening 7 lies at the bottom (below or in the region of the liquid level), this wide opening 7 is completely freely accessible to the liquid flowing up to it and the webs 8 then represent a virtually insignificant obstacle to the flow as they now conversely deflect the flowing liquid inwards in the direction of the wide opening 7, wherein the narrow opening 6 then acts as venting opening.

At the same time the webs 8 also serve as reinforcing elements when the detachable portion 1' of the membrane is torn out and thus ensure that a precisely defined, desired shape of the pouring opening with the sections 6 and 7 is produced.

REFERENCE NUMBERS

1 membrane
1' detachable section
2 line of weakness
5 opening (as a whole)
6 narrow part of the opening
7 wide part of the opening
8 web
9 transition region
10 pour spout
11 rib
12 pull-ring
20 closure casing
30 threaded attachment
100 closure

The invention claimed is:

1. Pouring closure for liquid containers, with a pour spout which can be sealingly fixed to a container neck and the cross section of which is closed by a membrane before use, wherein a portion of the membrane extending transversely over the membrane and approximately pear-shaped in plan view, is connected to the remaining portion via an easily tearable line of weakness and can be detached from the membrane, with the result that after the detachment it releases an opening in the membrane, which is correspondingly pear-shaped in plan view, with the result that liquid can be poured selectively out of a relatively narrower section or out of a relatively wider section of the pear-shaped opening when the container is tilted, depending on the orientation thereof, wherein the membrane has webs on its inner surface, at a close distance beside the line of weakness and outside the tear-out section, which extend inwards away from the membrane surface, and which run on both sides of the narrow section of the tear-out portion or of the opening and along at least a portion of a transition region between the narrower and the wider sections, and wherein the web height increases from the beginning of the web close to its first end of the narrow section remote from the wide section as it approaches the transition region.

2. Pouring closure according to claim 1, wherein the maximum height of the webs, measured perpendicular to the membrane surface, is between 2 and 10 mm and is more than 10% and up to 50% of the internal diameter of the pour spout.

3. Pouring closure according to claim 1, wherein the web height, from the beginning of the webs close to their first end of the narrow section remote from the wide section, at least doubles up to a maximum web height as it approaches the transition region.

4. Pouring closure according to claim 1, wherein the web height decreases by at least 50% from a maximum height in the transition region to the second end beside the wider section (7).

5. Pouring closure according to claim 1, wherein the minimum height of the webs close to the free end of the narrow section of the opening is 1 mm.

6. Pouring closure according to claim 1, wherein the webs extend beyond the transition region, but end at a distance before an outer edge of the membrane.

7. Pouring closure according to claim 1, wherein the distance of the webs from the line of weakness along the narrow section and optionally along the transition region is at most 10% of the membrane diameter and is at most 3 mm.

8. Pouring closure according to claim 1, wherein the narrow section of the tear-out portion of the membrane has a reinforcing rib extending parallel to both edges of the narrow section, which optionally extends on the inner surface of the membrane.

9. Pouring closure according to claim 1, wherein the pear-shaped opening extends approximately over the whole diameter of the membrane with its free ends of the narrow and of the wide section facing away from each other and optionally comprises the geometric centre of the membrane.

10. Pouring closure according to claim 1, wherein the narrow section has a maximum width which is less than one quarter of the membrane diameter and the wide section has a maximum width which is more than one third of the membrane diameter.

11. Pouring closure according to claim 1, wherein an edge of the pear-shaped opening in the narrow and in the wide section has a substantially convex shape or runs in a straight line, wherein the transition region between the narrow and the wide sections is defined by the fact that it has a concave course.

12. Pouring closure according to claim 1, wherein the transition region is defined by the section between 45% and 55% of the distance between the free ends of the narrow and of the wide section lying opposite each other.

13. Pouring closure according to claim 1, wherein the narrow section extends approximately from an edge to the centre of the membrane.

14. Pouring closure according to claim 1, wherein the cross section of the narrow section is less than one third of the cross section of the wide section.

15. Pouring closure according to claim 1, wherein the cross-sectional area of the wide section is at least one sixth of the whole membrane surface area.

16. Pouring closure according to claim 1, wherein an end of the wide section is provided with a pull-out aid.

17. Pouring closure according to claim 16, wherein the pull-out aid is formed as a pull-ring.

18. Pouring closure according to claim 1, wherein the narrow section has a maximum width which is less than 15% of the membrane diameter and the wide section has a maximum width which is more than half of the membrane diameter.

19. Pouring closure according to claim 1, wherein the cross-sectional area of the wide section is at least one quarter of the whole membrane surface area.

* * * * *